US006382169B1

(12) United States Patent
Gausman

(10) Patent No.: US 6,382,169 B1
(45) Date of Patent: May 7, 2002

(54) MOTORCYCLE THERMOSTAT PLACEMENT BRACKET ASSEMBLY AND METHOD

(76) Inventor: Gary A. Gausman, 3912 Sunset Blvd., Erie, PA (US) 16504

( * ) Notice: Subject to any disclaimer, the term of this patent is extended or adjusted under 35 U.S.C. 154(b) by 0 days.

(21) Appl. No.: 09/794,267

(22) Filed: Feb. 27, 2001

(51) Int. Cl.[7] ..... F02F 7/00

(52) U.S. Cl. ..... 123/195 R; 123/41.12; 123/41.65

(58) Field of Search ..... 123/195 R, 41.12, 123/41.65

(56) References Cited

U.S. PATENT DOCUMENTS

| | | | |
|---|---|---|---|
| 4,108,118 | A | 8/1978 | George |
| 4,170,260 | A | 10/1979 | Rudd et al. |
| 4,392,464 | A | 7/1983 | Woodward et al. |
| 4,546,843 | A | 10/1985 | Koinuma et al. |
| 4,770,262 | A | 9/1988 | Yasunaga et al. |
| 5,876,013 | A | 3/1999 | Ott |

OTHER PUBLICATIONS

Catalog—Harley Davidson 2001 Genuine Motor Accessories and Genuine Motor Parts, Front and Back Pages, and pp. 399/400, 2000 Harley–Davidson Motor Co. 4 pgs.

Instructions—Accessory Fan Kit—Kit No. 91531–00 J01515, Rev. Mar. 31, 1999, Harley–Davidson Motor Co. 5 pgs.

Instructions—Thermostat Repair Kit for Fan Kit, Kit No. 74453–00, J01605, REv. May 25, 1999, Harley–Davidson Motor Co. 1 pg.

*Primary Examiner*—Noah P. Kamen
(74) *Attorney, Agent, or Firm*—Jon L. Woodard, Esq.; MacDonald, Illig, Jones & Britton LLP

(57) ABSTRACT

A bracket assembly and method for positioning a cooling fan thermostat on a motorcycle engine so that the mounted thermostat is more responsive to actual changes in engine temperature. The bracket mounts on the engine's engine block near the base of the cylinders and positions the thermostat close to the cylinders' cooling fins. This positioning leaves the thermostat well below the lines of air flowing from the fan and prevents the thermostat from cooling before lowering the engine temperature below the preset maximum level. This positioning also leaves the thermostat closer to the cylinders which are the most significant sources of heat in the engine, making the thermostat more convectively responsive to the engine's actual temperature.

20 Claims, 4 Drawing Sheets

MOTORCYCLE THERMOSTAT PLACEMENT BRACKET ASSEMBLY AND METHOD

BACKGROUND

The present invention is directed to the field of thermostat placement brackets. More particularly, the present invention is directed to a bracket assembly and method for positioning a cooling fan thermostat on a motorcycle engine.

Air-cooled motorcycle engines normally incorporate cooling fins on each cylinder in order to increase both the conductive and convective dissipation of waste heat. As a motorcycle travels, air flows over the cooling fins and increases the fins' heat dissipating efficiency. However, this increase in efficiency lasts only as long as a constant airflow continues to pass over the cooling fins. When the motorcycle is traveling or idling at low speeds, airflow over the cooling fins is reduced or eliminated, significantly limiting the ability of the cooling fins to dissipate heat. If an engine is operated for extended periods, under extreme conditions, or in an environment that is enclosed or partially shielded from the wind, overheating and subsequent engine failure or damage can result.

In order to improve air flow and thereby improve heat dissipation from the surfaces of an engine's cooling fins, cooling fans are often installed as optional equipment on motorcycles. Such fans are typically operated with a thermostat and are positioned to draw in and blow air laterally across each of the engine's cylinders. If during operation, a motorcycle's forward movement produces sufficient air flow to remove most of the excessive waste heat generated, it is possible that no additional heat dissipation will be necessary. If however, air flow is reduced due to idling, insufficient speed, extreme conditions, or an obstruction, waste heat will likely be generated faster than it can be dissipated by the cooling fins working alone. Therefore, a cooling fan's thermostat will normally be set to operate the cooling fan as soon as the engine's temperature surpasses a preselected maximum temperature. Once the cooling fan begins to operate, air continues to blow across the cooling fins, convectively removing heat from the surfaces of the cylinder and cooling fins and until the thermostat senses that temperature has been reduced below the preselected maximum level.

In prior art engines, such as the engine 10 depicted in FIG. 2, a cooling fan assembly (not shown) houses a fan (not shown) positioned to draw air over the engine's cylinders 20, the cylinders 20 being positioned on an engine block 22. As depicted in the side view of the same engine in FIG. 3, the fan draws and blows air 14 against the cylinders 20 and over the cylinders' cooling fins 18. The fan is operated by a thermostat 23 placed on an air cleaner housing 12. The thermostat 23 is placed at a position most proximate the cylinders 20 while still being positioned on the air cleaner housing 12. As best understood with reference to FIG. 3A, this positioning puts the thermostat 23 in the line of the flowing air 14. The thermostat 23 also remains separated from the engine block 22 and cylinders 20 by a substantial distance without having a direct structural interconnection.

Such previous configurations significantly limit the thermostat's temperature sensing ability. One result of the configuration is that heat must first convectively migrate the distance from the engine's cylinders 20 to the air cleaner housing 12 before it can be sensed by the thermostat 23, significantly delaying the thermostat's response time in reacting to temperature changes of the engine 10. Another result is that plastic and other materials which comprise the air cleaner housing 12 which surround the thermostat 23 tend to both insulate the thermostat 23 and dissipate ambient and radiant heat, further delaying the thermostat's response time to temperature changes and possibly subjecting the thermostat 23 to premature cooling. Such possible premature cooling can cause the cooling fan to shut off before the engine's temperature falls to below the preselected maximum level. Consequently, the lowered thermostat responsiveness of such previous designs inherently limits a fan's ability to effect engine cooling and to prevent overheating.

SUMMARY

The present invention is a bracket assembly and method for positioning a cooling fan thermostat on a motorcycle engine so that the mounted thermostat is more responsive to actual changes in engine temperature. A bracket mounts on the engine's engine block near the base of the cylinders and positions the thermostat close to the cylinders' cooling fins. This positioning leaves the thermostat well below the lines of air flowing from the fan and prevents the thermostat from cooling before lowering the engine temperature below the preset maximum level. This positioning also leaves the thermostat closer to the cylinders which are themselves the most significant sources of heat in the engine, making the thermostat more convectively responsive to the engine's actual temperature.

The bracket and/or the components of the bracket assembly may be made of a thermally conductive material. The bracket provides a single structural link between the engine block and the thermostat, permitting more efficient and conductive heat transfer between the engine and thermostat. Thus, the invention permits the thermostat to be both convectively and conductively more responsive to the engine temperature.

Some motorcycle engines have preexisting studs extending outward from the engine block near the bases of the cylinders. In such engines, a bracket assembly can be mounted by fitting a bracket over the existing stud and securing the bracket in position with a nut and washer. Many such engines have adjacently positioned screw caps which can interfere with the positioning of the bracket. Thus, some embodiments of the invention include shaved edges on the bracket and/or on some of the bracket assembly components to provide clearance against the cap screws. In some of these embodiments, one of the shaved edges can be positioned sufficiently proximate the screw cap to restrict undesired rotational movement of the bracket.

In other embodiments of the invention, a threaded mounting hole is added to an engine block if the engine lacks a stud near the base of its cylinders. These embodiments incorporate a threaded mounting bolt to fasten the bracket to the engine block. In some of these embodiments, a spacer is added to provide clearance between the bracket and engine block if such clearance is necessary to properly orient the bracket with respect to the cylinders.

Those skilled in the art will realize that this invention is capable of embodiments which are different from those shown and described below. It will be appreciated that details of the structure of this cooling fan thermostat bracket can be changed in various manners without departing from the scope of this invention. Accordingly, the drawings and Detailed Description of the Preferred Embodiments below are to be regarded as including such equivalent thermostat brackets as do not depart from the spirit and scope of the invention.

BRIEF DESCRIPTION OF THE DRAWINGS

For a more complete understanding and appreciation of this invention and many of its advantages, reference should be made to the following, detailed description taken in conjunction with the accompanying drawings wherein.

DETAILED DESCRIPTION OF THE PREFERRED EMBODIMENTS

Figure 1:
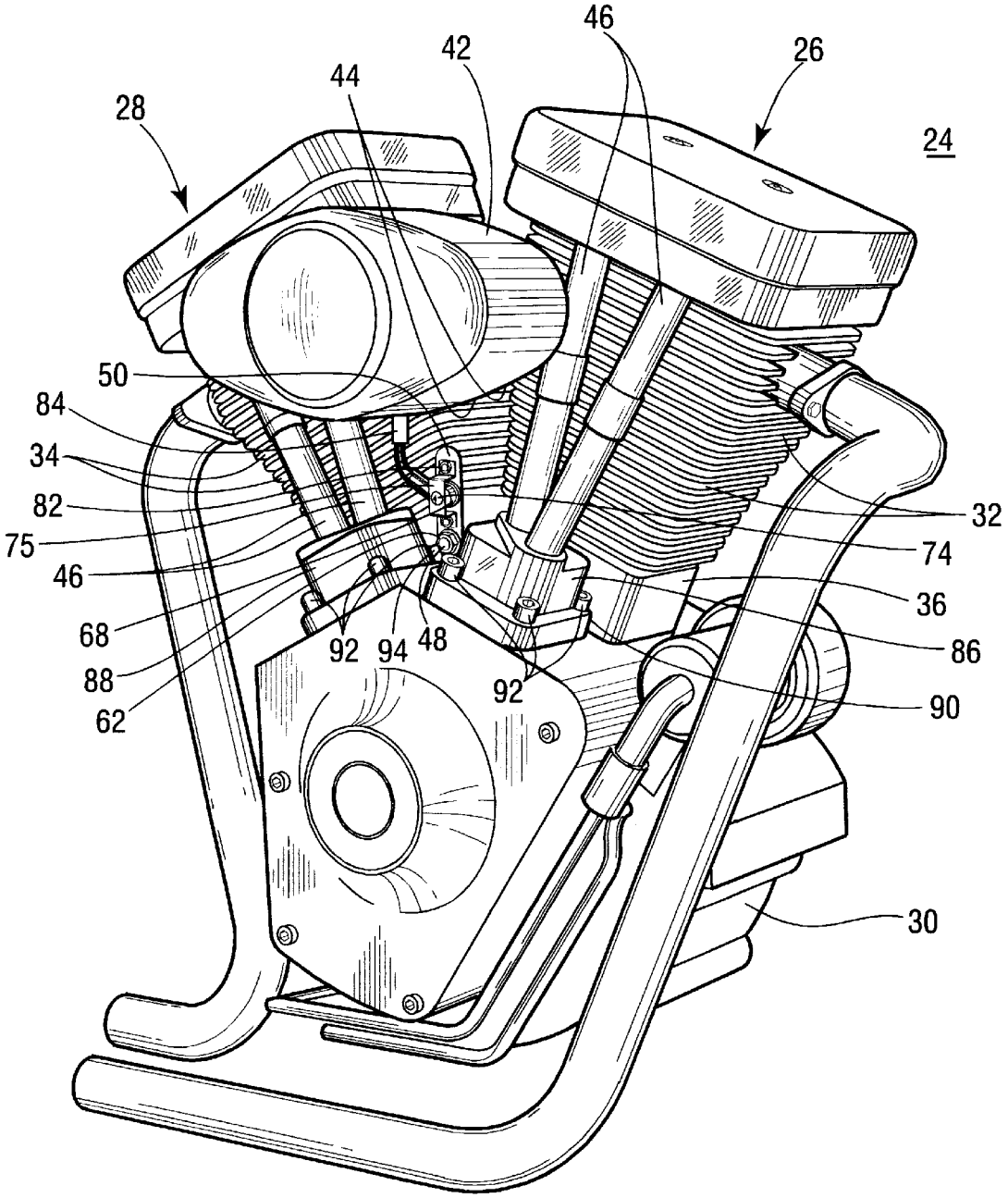
FIG. 1 is a perspective view of typical motorcycle engine having a thermostat positioned on a thermostat bracket according to the invention.
Figure 2:
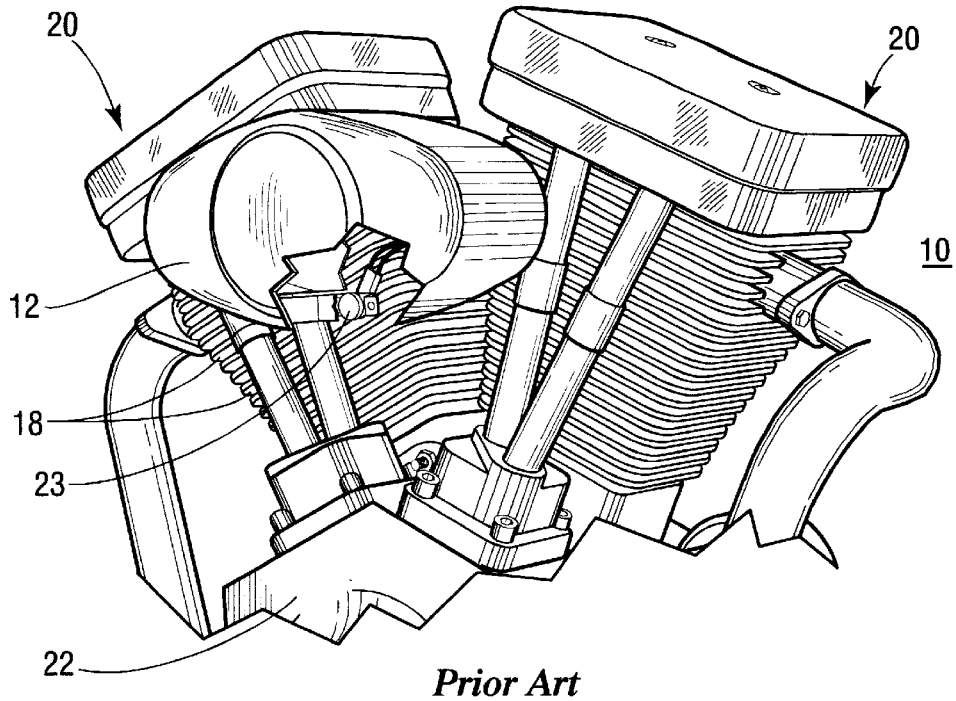
Prior Art Fig.2
FIG. 2 is a perspective view of a prior art motorcycle engine having a thermostat mounted to its air cleaner housing for comparison with the invention depicted in FIG. 1.

Referring to the drawings, identical reference numerals and letters designate the same or corresponding parts throughout the several figures shown in the drawings. In drawings depicting slight variations of the invention design, corresponding part numbers include the lowercase letter a.

FIG. 1 depicts a typical 2-cylinder motorcycle engine 24 having a front cylinder 26 and a rear cylinder 28 positioned on an engine block 30. Each cylinder 26 and 28 has a number of cooling fins 32 and 34 surrounding each cylinder for dissipating heat generated during engine operation. The cylinders 26 and 28 connect to the engine block 30 at their bases 36 and 38 (38 not shown in FIG. 1) and are proximately arranged in V-configuration (as shown). An air cleaner housing 42 is positioned to one side of the cylinders 26 and 28 and is separated from the cooling fins 32 and 34 by an intermediate space 44, as best understood with reference to FIG. 3B. As depicted in FIG. 3B, push rod housings 46 occupy the intermediate space 44. Referring again to FIG. 1, a thermostat bracket assembly 40 of the invention is positioned on the engine block 30 between the cylinders 26 and 28 near the cylinders' bases 36 and 38 (38 not shown in FIG. 1) on a stud 48 which extends outward from the engine block 30.

Figure 5:
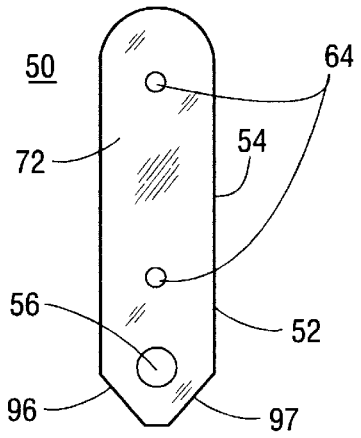
FIG. 5 is a side view of a bracket having shaved edges at its attachment end according to one embodiment of the invention.
Figure 6:
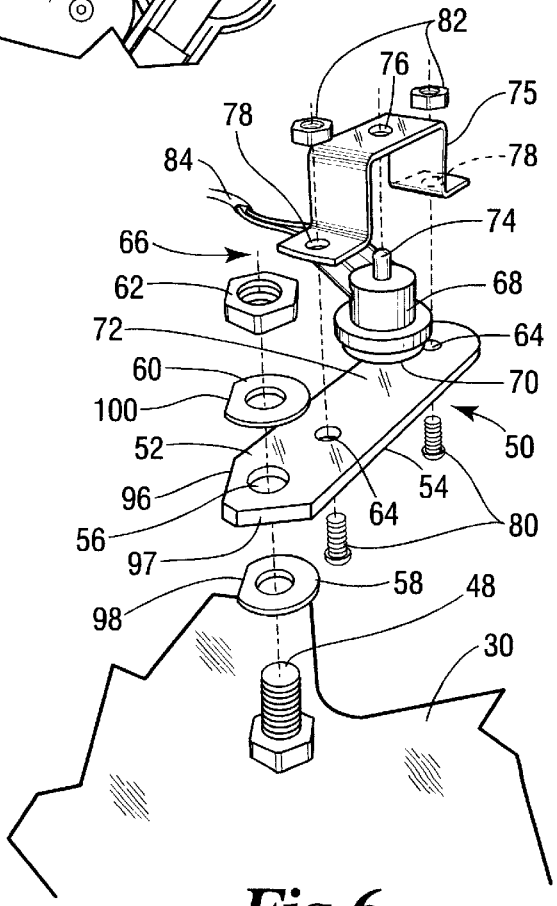
FIG. 6 is an exploded view depicting the various components of the motorcycle thermostat bracket assembly of FIG. 4 according to one embodiment of the invention.

The outward extension of the stud 48 can be best understood in FIG. 3B. The stud 48 extends outward from the engine block 30 between the cylinders 26 and 28 and adjacent the cylinder's bases 36 and 38. A thermostat bracket assembly 40 of the invention is mounted to the engine block 30 on the stud 48. The components of the bracket assembly 40 are depicted in the exploded view of FIG. 6. The bracket assembly 40 is constructed around a bracket 50 having an attachment end 52 and a positioning end 54 that includes a flat attachment surface 72. The bracket 50 is itself depicted in FIG. 5.

An attachment hole 56 extends through the attachment end 52 of the bracket 50. When the bracket 50 is mounted on the engine block 30, the stud 48 extends through the attachment hole 56, the bracket 50 being secured in place with an inside washer 58, outside washer 60, and a nut 62. The stud 48, bracket 50, and other components of the bracket assembly 40 are ideally constructed of one or more thermally conductive materials such as steel, copper, or aluminum, in order to permit the flow of conductive heat from the engine block 30 to the positioning end 54 of the bracket 50. The positioning end 54 of the bracket 50 includes two positioning holes 64 for attaching a thermostat assembly 66.

Figure 4:
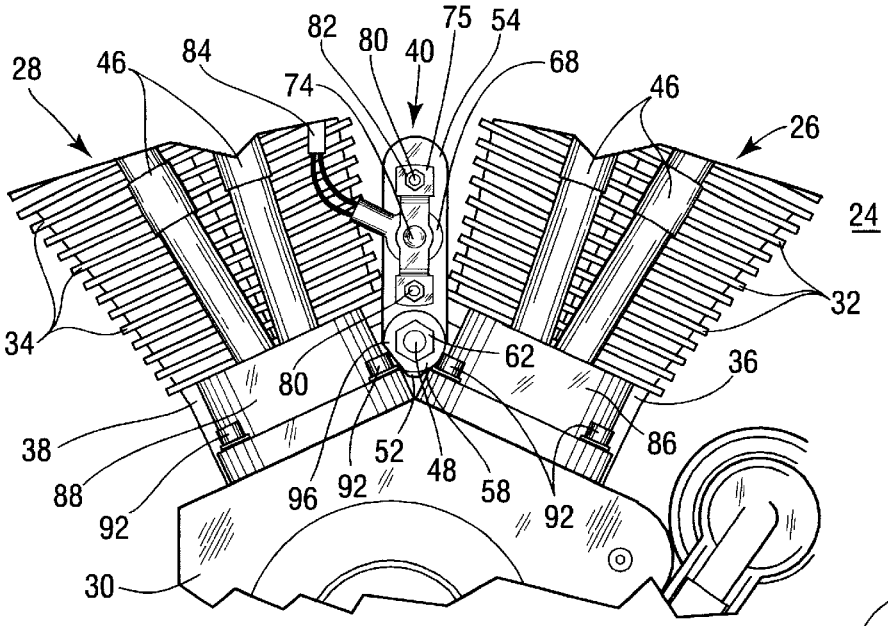
FIG. 4 is a side view of the motorcycle engine of FIG. 3B further depicting the bracket assembly's proximity to an adjacent screw cap on one lifter housing and the shaved edges at the bracket's attachment end for providing clearance and for restricting rotation of the bracket on its stud.

The thermostat assembly 66 includes a thermostat 68 having a flat positioning surface 70 and having a plastic attachment tab 74. The thermostat assembly 66 also includes a thermostat mount 75 having a through hole 76 for connecting to the thermostat 68 and two connecting holes 78 for attaching to the bracket assembly 50. When assembled, the thermostat 68 connects to the thermostat mount 75 with the plastic attachment tab 74 extending through the through hole 76. The plastic attachment tab 74 is typically made of plastic or another formable material and is melted to lock the thermostat 68 in place after being inserted into the through hole 76 (as shown in FIG. 4). The thermostat assembly 66 connects to the bracket 50 by aligning connecting holes 78 of the thermostat mount 75 to positioning holes 64 extending through the attachment surface 72 in the bracket 50 so that the flat positioning surface 70 rests flat against the attachment surface 72. Positioning screws 80 extend through both the positioning holes 64 and connecting holes 78 and are fastened with positioning nuts 82, securing the thermostat assembly 66 to the bracket 50.

Some engines, such as the one depicted in FIGS. 1 and 4, have one or more lifter blocks 86 and 88 positioned adjacent the stud 48 extending from the engine block 30. As is the case with the engine 24 depicted in FIGS. 1 and 4, one or more of the lifter blocks 86 and 88 may be sufficiently close to the stud 48 to potentially interfere with the mounting of the thermostat bracket 50. For example, on the engine 24 of FIGS. 1 and 4, both the forward lifter block 86 and the rear lifter block 88 are proximate to the stud 48. Each lifter block 86 and 88 has screw caps 92 positioned at each corner. As seen in FIG. 1, an intermediate gap 90 separates the base 36 of the front cylinder 26 from the forward lifter block 86, permitting the bracket 50 and washers 58 and 60 to fit substantially flush with the engine block 30 when mounted on the stud 48. However, a much smaller intermediate gap (not shown) exists between the rear lifter block 88 and the base 38 of the rear cylinder 28.

As best understood by comparing FIG. 1 with FIG. 4, the result of this positioning is that the rear lifter block 88 has one screw cap 94 that can block the mounting of the bracket 50 and washers 58 and 60 on the stud 48. For this reason, the bracket 50 has a first shaved lower edge 96 at its attachment end 52 to provide clearance from the most adjacent screw cap 94. The inside washer 58 and outside washer 60 have similarly shaved respective edges 98 and 100 to also allow for clearance with the adjacent screw cap 94. In some designs, such as that depicted in FIGS. 1 and 4, the first shaved lower edge 96 of the bracket 50 can be sufficiently close to the adjacent screw cap 94 that the first shaved lower edge 96 is used to prevent undesired rotation of the bracket 50 about the stud 48.

The intermediate gap 90 separating the base 36 of the front cylinder 26 from the forward lifter block 86 increases the clearance between the stud 48 and the adjacent forward lifter block 86. In some engine models, this intermediate gap 90 may be sufficiently small to permit the forward lifter block 86 to interfere with the mounting of the bracket 50, though it is generally not sufficiently small to permit interference with the mounting of the washers 58 and 60. To prevent potential interference from the forward lifter block 86, a second shaved lower edge 97 is positioned at the bracket's attachment end 52 to provide the necessary clearance for mounting.

Figure 3A:
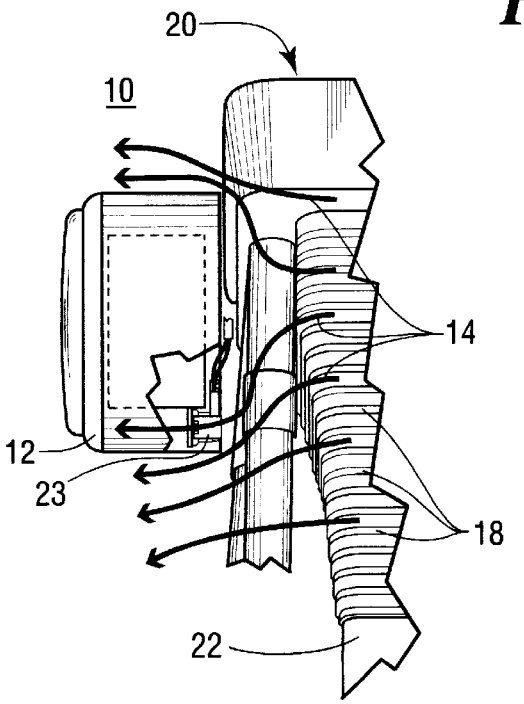
Prior Art Fig.3A
FIG. 3A is a front view of the motorcycle engine of FIG. 2, depicting the thermostat's relative positioning with respect to the line of airflow from the cooling fan and the engine's cylinders.
Figure 3B:
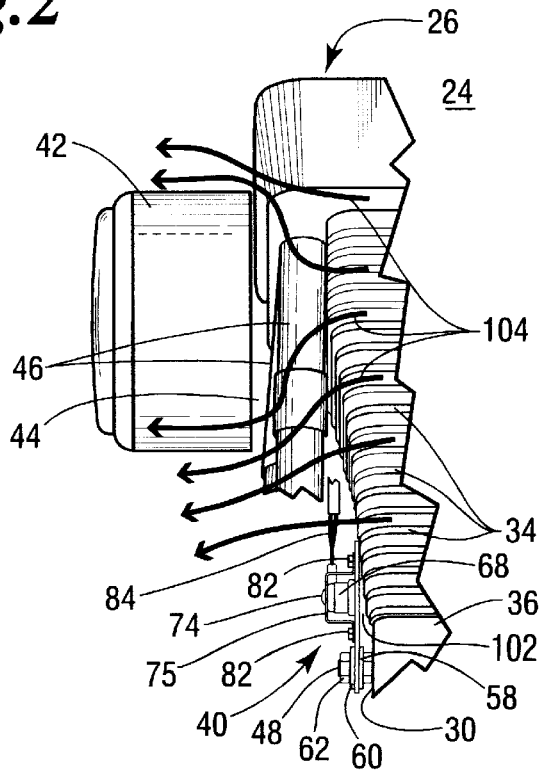
FIG. 3B is a front view of the motorcycle engine of the invention of FIG. 1 depicting the relative positioning of the thermostat with respect to the lines of air flowing from the cooling fan to the engine's cylinders according to one embodiment of the invention.

FIGS. 3B and 4 demonstrate certain advantages of the invention that are apparent when compared with previous designs such as that of FIG. 3A. When assembled, the thermostat bracket assembly 40 positions the thermostat 68 between the bases 36 and 38 of the cylinders 26 and 28 and closely adjacent the cooling fins 32 and 34. Thermostat wires 84 are routed behind the air cleaner housing 42 and allow the thermostat 68 to operate the fan. As best understood with reference to FIG. 3B, this positioning of the thermostat 68 substantially reduces the intermediate space 102 between the thermostat 68 and engine cylinders 26 and 28, which are the most significant sources of heat in the engine 24. The thermostat bracket 50 itself also improves heat relation by forming a direct structural link between the engine block 30 and the thermostat 68, permitting the relation of conductive heat. Thus, the thermostat bracket 40 improves the communication of both conductive and convective heat between the engine block 30, cylinders 32 and 34, and the thermostat 68, making the thermostat 68 more responsive to radiant heat resulting from increased engine temperatures.

The thermostat positioning depicted in FIG. 3B also allows the fan to cool the cylinders 26 and 28 without cooling the thermostat 68. FIG. 3B depicts lines of flowing air 104 being blown over the cooling fins 32 and 34. Due to the positioning of the thermostat 68 near the cylinders' bases 36 and 38, most of the flowing air 104 passes above the thermostat 68. The bracket's location allows the thermostat 68 to continue operating the fan without the thermostat itself being significantly affected by the effects of the flowing air 104. This minimizes the effect that the air 104 has on the thermostat's responsiveness, and may permit the fan to continue cooling the engine 24 for longer periods than previous configurations.

It will be appreciated that variations of the disclosed bracket design are also possible. For example, some models of motorcycle engines do not include a stud extending from the engine block near the bases of the engine's cylinders. Sufficient vertical clearance for the addition of a bracket to the engine block may be similarly lacking. Some models may also include lifter blocks which, due to their relative spacing, present no potential interference problems for mounting a thermostat bracket. Such engines lend themselves to slight variations in configurations of thermostat bracket assemblies without departing from the intended scope of the invention.

Figure 7:
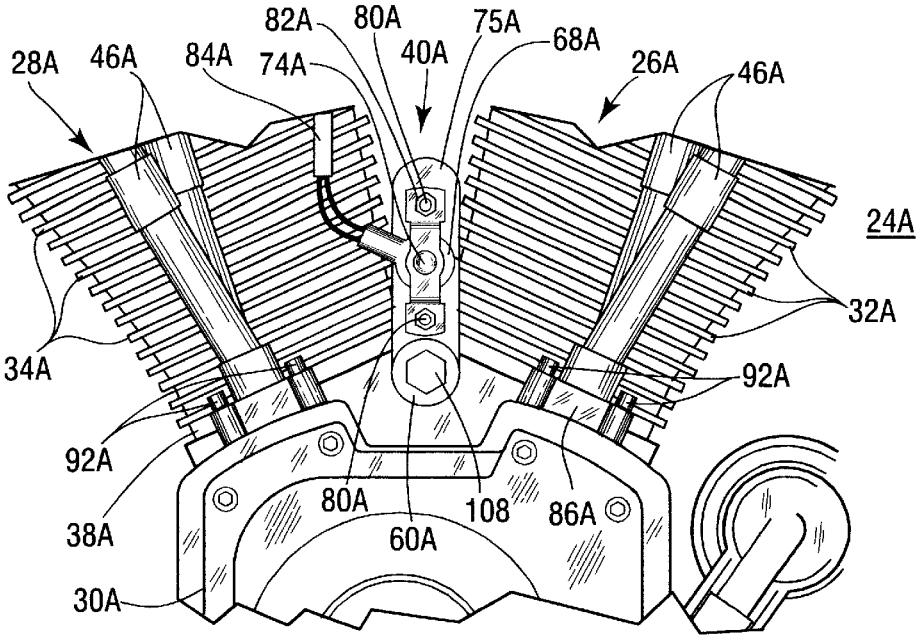
FIG. 7 is a side view of a motorcycle engine having an alternate thermostat bracket assembly for engines lacking a stud proximate the bases of the engine's cylinders.
Figure 9:
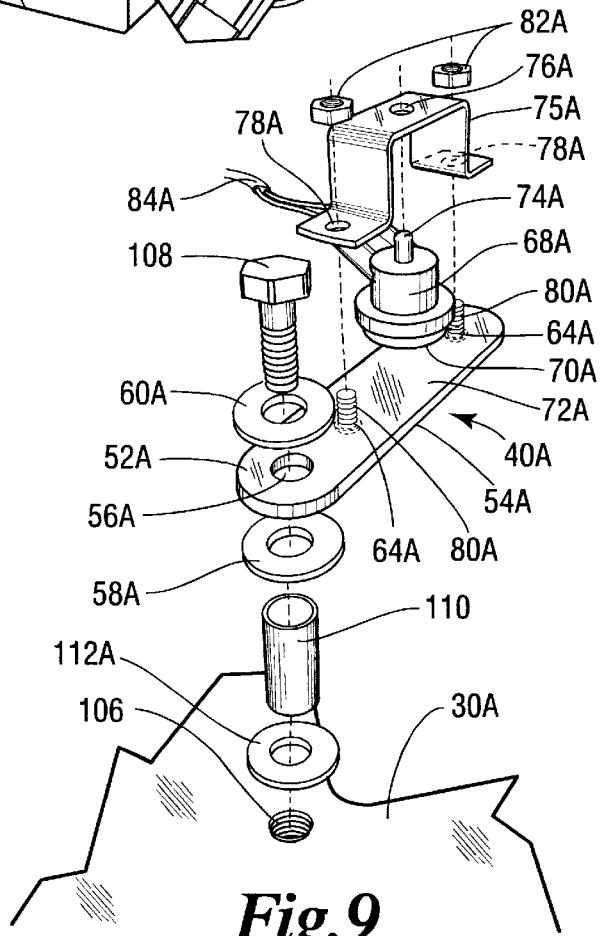
FIG. 9 is an exploded view depicting the various components of the motorcycle thermostat bracket assembly of FIG. 7, including a spacer positioned between the engine block and bracket according to one embodiment of the invention.

For example, FIG. 7 depicts a motorcycle engine 24*a* lacking a stud that extends from its engine block 30*a* between the cylinders 26*a* and 28*a*. In order to properly mount the thermostat bracket 40*a* between the cylinders 26*a* and 28*a*, a threaded mounting hole 106 must be added to the engine block 30*a*. A threaded mounting bolt 108 is then be added to the bracket assembly 40*a* to attach the bracket 50*a* to the engine 24*a*. An exploded view of such a bracket assembly 40*a* is depicted in FIG. 9. The threaded bolt 108 extends through the attachment hole 56*a* of the bracket's attachment end 52*a*. This allows the bracket 50*a* to be secured to the engine block 30*a* by screwing the threaded bolt 108 into the threaded mounting hole 106. An inside washer 58*a* and an outside washer 60*a* are on either side of the attachment hole 56*a*.

Some engines may not provide sufficient vertical clearance above the engine block 30*a* to enable the bracket 40*a* to fit near the bases of the cylinders 26*a* and 28*a*. Such engines may require the use of a spacer 110, to provide additional clearance between the bracket 50*a* and engine block 30*a*. An additional spacer washer 112*a* may be positioned between the spacer 110 and engine block 30*a* in order to provide additional stability for the spacer 110.

Figure 8:
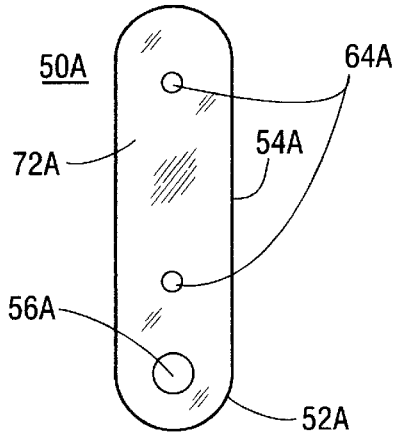
FIG. 8 is a side view of the bracket used in the thermostat bracket assembly of FIG. 7.

An additional variation of the engine 24*a* depicted in FIG. 7 includes increased spacing of the lifter blocks 86*a* and 88*a* away from the thermostat bracket 50*a*. As shown, the spacing between the lifter blocks 86*a* and 88*a* and the thermostat bracket 50*a* is sufficiently large to prevent the blocks 86*a* and 88*a* from interfering with the proper mounting of the bracket 50*a*. Therefore, it is not necessary to include shaved lower edges on the attachment end 52*a* of the bracket 50*a*. The accordingly modified bracket 50*a* is depicted in FIG. 8 and incorporated into the assembled unit as shown in FIG. 7 and FIG. 9.

Those skilled in the art will recognize that the various features of this invention described above can be used in various combinations with other elements without departing from the scope of the invention. Thus, the appended claims are intended to be interpreted to cover such equivalent thermostat brackets which do not depart from the spirit and scope of the invention.

What is claimed is:

1. A bracket assembly for positioning an air fan thermostat on an engine, the engine having an engine block and at least one cylinder having a base, the cylinder connected at its base to the engine block, the bracket assembly comprising:

a bracket having an attachment end and a positioning end, said attachment and positioning ends being spaced apart from each other along the length of said bracket;

said attachment end being attachable to the engine block for coupling said bracket to the engine's engine block; and said positioning end having an attachment surface for mounting a thermostat thereto when the thermostat is mounted on said positioning end of said bracket to cause the thermostat to be proximate the cylinder.

2. A bracket assembly for positioning an air fan thermostat on an engine, the engine having an engine block and at least two cylinders having bases and connected at their bases to the engine block, the bracket assembly comprising:

a bracket having an attachment end and a positioning end, said attachment and positioning ends being spaced apart from each other along the length of said bracket;

said attachment end being attachable to the engine block near the bases of two of the engine's cylinders for coupling said bracket to the engine block; and said positioning end having an attachment surface for mounting a thermostat thereto wherein mounting the thermostat to said positioning end of said bracket positions the thermostat proximate each of the cylinders.

3. The bracket assembly for positioning an air fan thermostat of claim 2, the engine having a stud extending outward from its engine block near the bases of two of the engine's cylinders, said bracket assembly further comprising:

an attachment hole extending through said attachment end of said bracket and having a size which allows the engine stud to extend therethrough;

a washer and a nut to be positioned on the engine stud over said attachment hole for fastening said bracket to said engine block.

4. The bracket assembly for positioning an air fan thermostat of claim 2, the engine having a stud extending outward from its engine block near the bases of two of the engine's cylinders, the engine also including a rear lifter block having a screw cap positioned adjacent the stud, said bracket assembly further comprising:

an attachment hole extending through said attachment end of said bracket, and having a size which, when said bracket is mounted on the engine, allows the engine stud to extend through said attachment hole;

a washer and a nut to be positioned on the engine stud over said attachment hole for fastening said bracket to the engine block; and a first shaved lower edge at said attachment end of said bracket to permit clearance between the screw cap on the rear lifter block and said bracket.

5. The bracket assembly for positioning an air fan thermostat of claim 2, the engine having a stud extending outward from its engine block near the bases of two of the engine's cylinders, the engine also including a rear lifter block having a screw cap positioned proximate the stud, said bracket assembly further comprising:

an attachment hole extending through said attachment end of said bracket, and having a size which, when said bracket is mounted on the engine, allows the engine stud to extend through said attachment hole;

a washer and a nut positioned on the engine's stud over said attachment hole to securely fasten said bracket against the engine block; and a first shaved lower edge at said attachment end of said bracket to permit said bracket to fit adjacent said screw cap of the rear lifter block, said first shaved lower edge being positioned sufficiently proximate thereto that the screw cap on the rear lifter block restricts rotational movement of said bracket on the engine's stud.

6. The bracket assembly for positioning an air fan thermostat of claim 2, the engine having a stud extending outward from its engine block near the bases of two of the engine's cylinders, the engine also including a rear lifter block having a screw cap positioned adjacent said stud, said bracket assembly further comprising:

an attachment hole extending through said attachment end of said bracket, and having a size which, when said bracket is mounted on the engine, allows the engine stud to extend through said attachment hole;

a washer and a nut to be positioned on the engine stud over said attachment hole to securely fasten said bracket against the engine block; and said washer having a shaved lower edge to permit said bracket to fit adjacent the screw cap of the rear lifter block.

7. The bracket assembly for positioning an air fan thermostat of claim 2, the engine having a stud extending outward from its engine block near the bases of two of the engine's cylinders, the engine also including a front lifter block positioned adjacent the stud, said bracket assembly further comprising:

an attachment hole extending through said attachment end of said bracket, and having a size which, when said bracket is mounted on the engine, allows the engine stud to extend through said attachment hole;

a washer and a nut to be positioned on the engine stud over said attachment hole for fastening said bracket to the engine block; and a second shaved lower edge at said attachment end of said bracket to permit clearance between the front lifter block and said bracket.

8. The bracket assembly for positioning an air fan thermostat of claim 2, the engine block having a threaded mounting hole positioned therein and adjacent the bases of the engine's cylinders, said bracket assembly further comprising:

an attachment hole extending through said attachment end of said bracket; and a threaded mounting bolt extending through said attachment hole of said bracket and having a size which enables it to be inserted into the threaded mounting hole positioned in the engine block, to fasten said bracket against the engine block.

9. The bracket assembly for positioning an air fan thermostat of claim 2, the bracket assembly further comprising a spacer positioned to provide clearance between said bracket and the engine block.

10. The bracket assembly for positioning an air fan thermostat of claim 2, said bracket assembly further comprising at least one heat conductive material for facilitating heat transfer from said engine to said thermostat.

11. A bracket assembly and air fan thermostat combination for an engine, the engine having an engine block and at least one cylinder having a base, the cylinder connected at its base to the engine block, the bracket assembly and air fan thermostat combination comprising:

a bracket having an attachment end and a positioning end, said attachment and positioning ends being spaced apart from each other along the length of said bracket;

said attachment end being attachable to the engine block for coupling said bracket to the engine block; and said positioning end having an attachment surface, said attachment surface having an air fan thermostat mounted thereon, the thermostat being proximate the cylinder when the thermostat is mounted on said positioning end.

12. A bracket assembly and air fan thermostat combination for an engine, the engine having an engine block and at least two cylinders having bases and connected at their bases to the engine block, the bracket assembly and air fan thermostat combination comprising:

a bracket having an attachment end and a positioning end, said attachment and positioning ends being spaced apart from each other along the length of said bracket;

said attachment end being attachable to the engine block near the bases of two of the engine's cylinders for coupling said bracket to the engine block; and an air fan thermostat mounted on said positioning end at a location which causes said thermostat to be proximate each cylinder when the attachment end is attached to the engine block.

13. The bracket assembly and air fan thermostat combination for an engine of claim 12, the engine having a stud extending outward from its engine block near the bases of two of the engine's cylinders, said bracket assembly and air fan thermostat combination further comprising:

an attachment hole extending through said attachment end of said bracket and having a size which allows the engine stud to extend therethrough;

a washer and a nut having a size which enables them to be positioned on the engine stud over said attachment hole for fastening said bracket to said engine block.

14. The bracket assembly and air fan thermostat combination for an engine of claim 12, the engine block having a threaded mounting hole positioned therein and adjacent the bases of the engine's cylinders, said bracket assembly and air fan thermostat combination further comprising:

an attachment hole extending through said attachment end of said bracket; and a threaded mounting bolt extending through said attachment hole of said bracket and having a size which enables it to be inserted into the threaded mounting hole positioned in the engine block to fasten said bracket against the engine block.

15. A motorcycle engine comprising:

an engine block and at least two cylinders each having a base, each said cylinder connected at its base to said engine block at a location that is adjacent the other cylinder; and a bracket assembly having a bracket, said bracket having an attachment end and a positioning end, said positioning end of said bracket having an air fan thermostat attached thereto, said bracket being securely attached to said engine block at said attachment end and positioned approximately between said cylinders and adjacent the cylinders' bases for facilitating heat transfer between said cylinders and said thermostat.

16. A method for mounting a thermostat on a motorcycle engine, the engine having at least one engine block and at least one cylinder having a base, the cylinder connected at its base to the engine block, the method comprising:

providing a bracket having an attachment end and a positioning end, mounting the thermostat to the positioning end of the bracket;

mounting the attachment end of the bracket to the engine block and positioning the thermostat at the positioning end of the bracket at a location adjacent the base of the at least one cylinder.

17. A method for mounting a thermostat on a motorcycle engine, the engine having an engine block and at least two cylinders having bases, each cylinder connected at its base to the engine block at a location that is adjacent the other cylinder, a stud extending outward from the engine block near the bases of two of the engine's cylinders, the engine also including a rear lifter block having a screw cap positioned adjacent the stud, the method comprising:

providing a bracket having an attachment end, a positioning end, an attachment hole and at least one shaved lower edge at the attachment end of the bracket, and a positioning surface at the positioning end of the bracket;

attaching a thermostat to the positioning surface of the bracket; and mounting the bracket on the stud extending through the attachment hole of the bracket, and positioning the thermostat at a location proximate the bases of two of the engine's cylinders such that the at least one shaved lower edge at the attachment end of the bracket clears the screw cap on the rear lifter block.

18. The method for mounting a thermostat on a motorcycle engine of claim 17 further comprising placing the attachment end of the bracket sufficiently close to the screw cap on the rear lifter block so that the shaved lower edge of the bracket contacts the screw cap, thereby preventing rotation of the bracket on the stud.

19. A method for mounting a thermostat on a motorcycle engine, the engine having an engine block and at least two cylinders having bases, each cylinder connected at its base to the engine block at a location that is adjacent the other cylinder, a threaded mounting hole positioned in the engine block adjacent the bases of the engine's cylinders, said method comprising:

providing a bracket having an attachment end, a positioning end, an attachment hole at the bracket's attachment end, and a positioning surface at the positioning end of the bracket;

attaching a thermostat to the positioning surface of the bracket;

inserting a threaded mounting bolt through the attachment hole of the bracket; and inserting the threaded mounting bolt into the threaded mounting hole in the engine block to securely fasten the bracket against the engine block.

20. The method for mounting a thermostat on a motorcycle engine of claim 19 further comprising positioning a spacer at a location so as to provide clearance between the bracket and the engine block.

* * * * *